US005724924A

United States Patent [19]

Michels

[11] Patent Number: 5,724,924

[45] Date of Patent: Mar. 10, 1998

[54] METHOD FOR CONTROLLING A COOLING CIRCUIT FOR AN INTERNAL-COMBUSTION ENGINE USING A COOLANT TEMPERATURE DIFFERENCE VALUE

[75] Inventor: Karsten Michels, Braunschweig, Germany

[73] Assignee: Volkswagen AG, Wolfsburg, Germany

[21] Appl. No.: 611,344

[22] Filed: Feb. 6, 1996

[30] Foreign Application Priority Data

Mar. 8, 1995 [DE] Germany ..... 195 08 104.8

[51] Int. Cl.[6] ..... F01P 7/02

[52] U.S. Cl. ..... 123/41.12; 123/41.44

[58] Field of Search ..... 123/41, 12, 44

[56] References Cited

FOREIGN PATENT DOCUMENTS

| | | |
|---|---|---|
| 0054476 | 6/1982 | European Pat. Off. . |
| 557113A2 | 8/1993 | European Pat. Off. . |
| 2384106 | 10/1978 | France . |
| 3024209 | 1/1981 | Germany . |
| 3439438 | 5/1985 | Germany . |
| 3810174 | 10/1989 | Germany . |
| 4238364 | 5/1994 | Germany . |
| 8400578 | 2/1984 | WIPO . |

OTHER PUBLICATIONS

Patent Abstract of Japan Pub. No. JP58074824 (6–5–93), Appl. No. JP810172132 (29–10–81); vol. 7, No. 169 (M–231) (26–07–58) Pat: A 58074824, Nissan Jidosha KK (6 May 1983).

*Primary Examiner*—Noah P. Kamen

*Attorney, Agent, or Firm*—Brumbaugh, Graves, Donohue & Raymond

[57] ABSTRACT

A method for controlling a cooling circuit of an internal combustion engine which includes a coolant pump for adjusting a coolant flow rate, a radiator in which heat is exchanged between the coolant and an air flow which can be controlled by a fan, and a control unit which controls at least the speed of the coolant pump and of the fan as a function of a required temperature value of the coolant. In order to shorten the warm-up phase of the engine and to minimize the power consumption of the pump and of the fan when the coolant temperature is below a selected low level, the speed of the coolant pump and the speed of the fan are controlled based on maintaining a required temperature difference of the coolant between the inlet and the outlet of the engine and, after the selected low level has been reached, the speed of the coolant pump and of the fan are controlled both as a function of the required temperature difference and of a required coolant temperature level at the engine outlet.

9 Claims, 4 Drawing Sheets

METHOD FOR CONTROLLING A COOLING CIRCUIT FOR AN INTERNAL-COMBUSTION ENGINE USING A COOLANT TEMPERATURE DIFFERENCE VALUE

BACKGROUND OF THE INVENTION

This invention relates to methods for controlling a cooling circuit for an internal combustion engine, in particular of a motor vehicle, in which the cooling circuit has at least one coolant pump for controlling coolant flow and a radiator in which heat is exchanged between the coolant and an air flow which can be controlled by a fan and which may include a temperature responsive valve for controlling the flow of coolant through a bypass and a control unit for controlling the coolant pulp and the fan.

European Published Application No. EP 45 476 A Jun. 2, 1996 describes an arrangement for controlling cooling of an internal combustion engine which has a coolant pump for producing the flow of coolant in a coolant circuit containing the internal combustion engine, a radiator, a fan for producing an air flow through the radiator, and a control unit which controls the air flow produced by the fan as a function of a required temperature value of the coolant. The coolant pump is driven by the internal combustion engine and thus produces a coolant flow which is dependent on the speed of the engine, requiring an excessive amount of power, in particular during the warm-up phase after the internal combustion engine has been started, and unnecessarily prolonging the warm-up phase of the internal combustion engine.

German Offenlegungsschrift No. DE 38 10 174 A1 describes an arrangement for controlling the coolant temperature of an internal combustion engine having a coolant pump and a fan which produces the air flow through a radiator. The coolant pump, which is driven by an electric motor, is also controlled as a function of a required temperature value. In this case, however, the required temperature value is predetermined as a function of the engine load and the engine speed. This also unnecessarily prolongs the warming-up phase since the coolant pump and the fan are controlled as a function of an engine operating point.

SUMMARY OF THE INVENTION

Accordingly, it is an object of the present invention to provide a method for controlling a cooling circuit for an internal combustion engine which overcomes disadvantages of the prior art.

Another object of the invention is to provide a method for controlling a cooling circuit for an internal combustion engine in which the power consumption of the coolant pump and of the fan is minimized while maintaining an optimum coolant temperature and the engine warm-up time is not extended by excessive coolant flow.

These and other objects of the invention are attained by selecting a coolant temperature for distinguishing between the warm-up phase after the internal combustion engine has been started and operation of the internal combustion engine at its operating temperature. Below the selected coolant temperature both the coolant flow produced by the coolant pump and the air flow produced by the fan are controlled as a function of a required temperature difference value between the coolant temperatures at the coolant inlet and the coolant outlet from the engine. After the selected coolant temperature has been reached, the coolant pump and the fan are controlled both as a function of the required coolant temperature difference value and as a function of a required temperature value of the coolant at the engine outlet.

The invention thus provides rapid warming-up of the internal combustion engine and shortening of the warm-up phase while preventing hot spots from being produced on individual components of the internal combustion engine because the required temperature difference value between the engine inlet and the engine outlet are maintained.

In one embodiment of the invention only the coolant flow produced by the pump is controlled as a function of the temperature difference and no air flow through the radiator module is produced by the fan at a coolant temperature below the selected temperature.

A further shortening of the warm-up phase may be achieved if the coolant pump produces no coolant flow and the fan produces no air flow when the coolant temperature is below an initial coolant temperature which is less than the selected coolant temperature for a predetermined time period after the engine has been started. The time period in which neither the coolant pump nor the fan is driven is selected so that no hot spots can occur in the engine.

Since brief changes in the engine load and the engine speed are irrelevant for the heat flow from the internal combustion engine into the coolant because of the thermal inertia of the internal combustion engine, a further aspect of the invention provides that the coolant pump and/or the fan which produces the air flow are/is driven as a function of the heat flow into the coolant. For this purpose the drive signals produced by the control unit are transmitted with a delay to the coolant pump and/or to the fan. The magnitude of the delay is selected so that the response time of the coolant pump and of the fan corresponds to the dynamic response of the heat flow of the coolant.

According to one aspect of the invention, after reaching the selected coolant temperature, the coolant flow produced by the pump and the air flow which can be set by the fan are controlled for minimum power input as a function of a time comparison of the efficiencies of the coolant pump and fan for heat dissipation from the radiator.

The selected coolant temperature to be maintained by control of the pump and the fan is preferably determined as a function of an engine coolant temperature which is optimum for each operating point of the internal combustion engine.

An advantageous design furthermore provides that an actual temperature difference value, which is required for control as a function of the required temperature difference value between the coolant input and the coolant outlet from the engine, is determined from the heat flow from the internal combustion engine into the coolant and from the coolant flow rate. The heat flow into the coolant, which is predetermined at least by the operating point of the internal combustion engine and by the coolant flow rate, is stored in the control unit as a performance graph for this purpose.

Both the power to be applied to the coolant pump as a function of the coolant flow produced thereby and the power to be applied to the fan to produce a specific air flow through the radiator as a function of the speed of movement of the motor vehicle are stored in a control unit and are used for the determination of the heat transfer efficiencies.

According to another aspect of the invention, a low temperature limit for the coolant is selected which preferably marks the end of the warm-up phase of the internal combustion engine and the operation of the coolant pump and the fan are controlled as a function of the comparison of the heat transfer efficiencies for the heat transmitted to the radiator only after the coolant has reached this low temperature limit. Below this temperature limit, the coolant pump produces only enough coolant flow to maintain a predetermined coolant temperature difference between the coolant inlet to the internal combustion engine and the coolant outlet.

The coolant circuit may also have a second flow path which bypasses the radiator. In this case the coolant temperature is adjusted during warm up until the low temperature limit is reached by controlling the flow through the second flow path, which has a variable cross section. The control is preferably implemented by a temperature-dependent valve, for example a thermostat. When the low temperature limit is exceeded, the operation of the coolant pump and of the fan are controlled as a function of the required temperature value by a comparison of their heat transfer efficiencies, in order to maintain the required temperature level.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
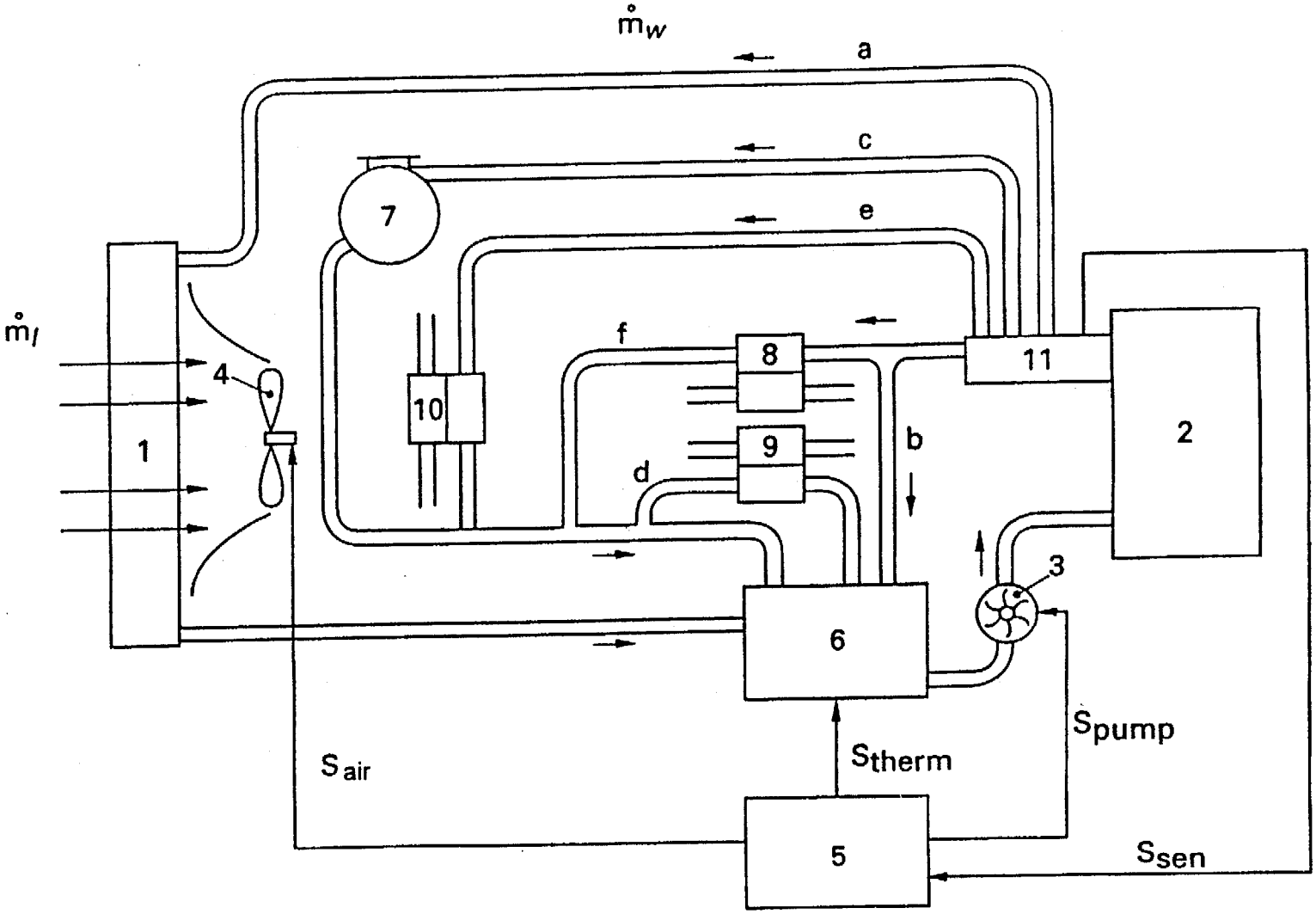
FIG. 1 is a schematic illustration showing a representative embodiment of a coolant circuit according to the invention.

The representative embodiment of a coolant circuit which is shown in FIG. 1 includes an internal combustion engine 2 of a motor vehicle and a plurality of pipes a–f having internal openings with a cross-section which can be controlled by a temperature-dependent thermostat valve 6. The circulation through these pipes of the coolant which is driven by a coolant pump 3 is indicated by arrows adjacent to the pipes. The pipe a leads from the engine 2 to a radiator 1 in which the coolant emerging from the engine 2 is cooled. For this purpose, air is drawn in from outside the motor vehicle by a fan 4 which is mounted behind the radiator 1. As the air passes through the radiator 1, heat is exchanged between the air flow $\dot{m}_1$, which can be controlled by the fan 4, and the coolant flow $\dot{m}_w$ Furthermore, the pipe b, which bypasses the radiator, has a cross section that can be controlled by the temperature dependent valve 6 in order to control the coolant temperature. The pipe c includes an expansion tank 7 and is used to regulate the pressure in the entire coolant circuit. The pipe d is connected to a heat exchanger 9 for heating the interior of the motor vehicle, and coolers 8 and 10, for cooling the engine oil and the transmission oil respectively, are arranged in the additional pipes e and f. The pipes d–f are optional since the corresponding cooling and heating functions can also be achieved in other ways.

Furthermore, the coolant system also includes a control unit 5, which may be the control unit for the internal combustion engine. The control unit receives, as an input signal, the output signal $S_{sen}$ of a temperature sensor 11 which detects the coolant temperature $T_{w,act}$ at the engine outlet and it produces output signals $S_{pump}$, $S_{air}$ and $S_{therm}$, to control the speed of both the coolant pump 3 and the fan 4 and also controls the temperature-dependent valve 6.

Figure 2:
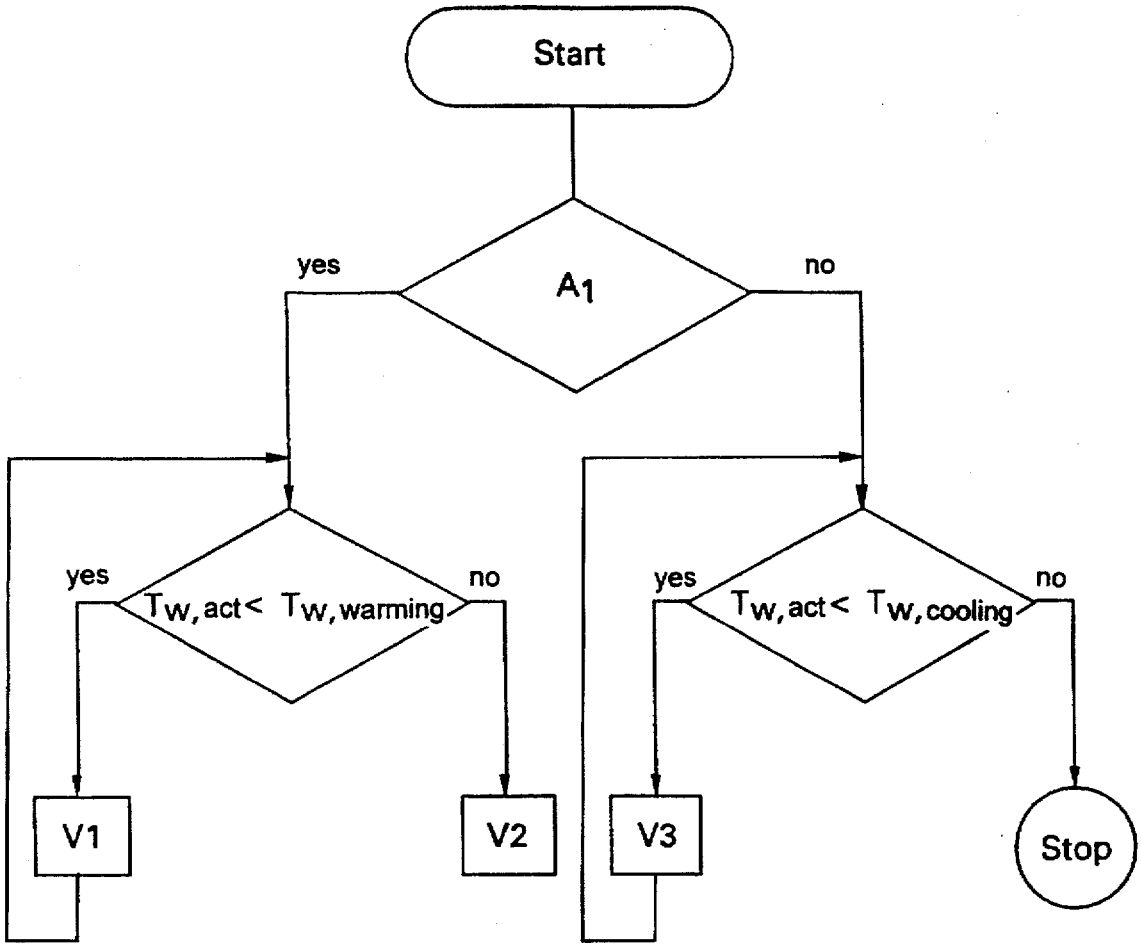
FIG. 2 is a flow chart illustrating a typical procedure for the method of the invention.
Figure 3:
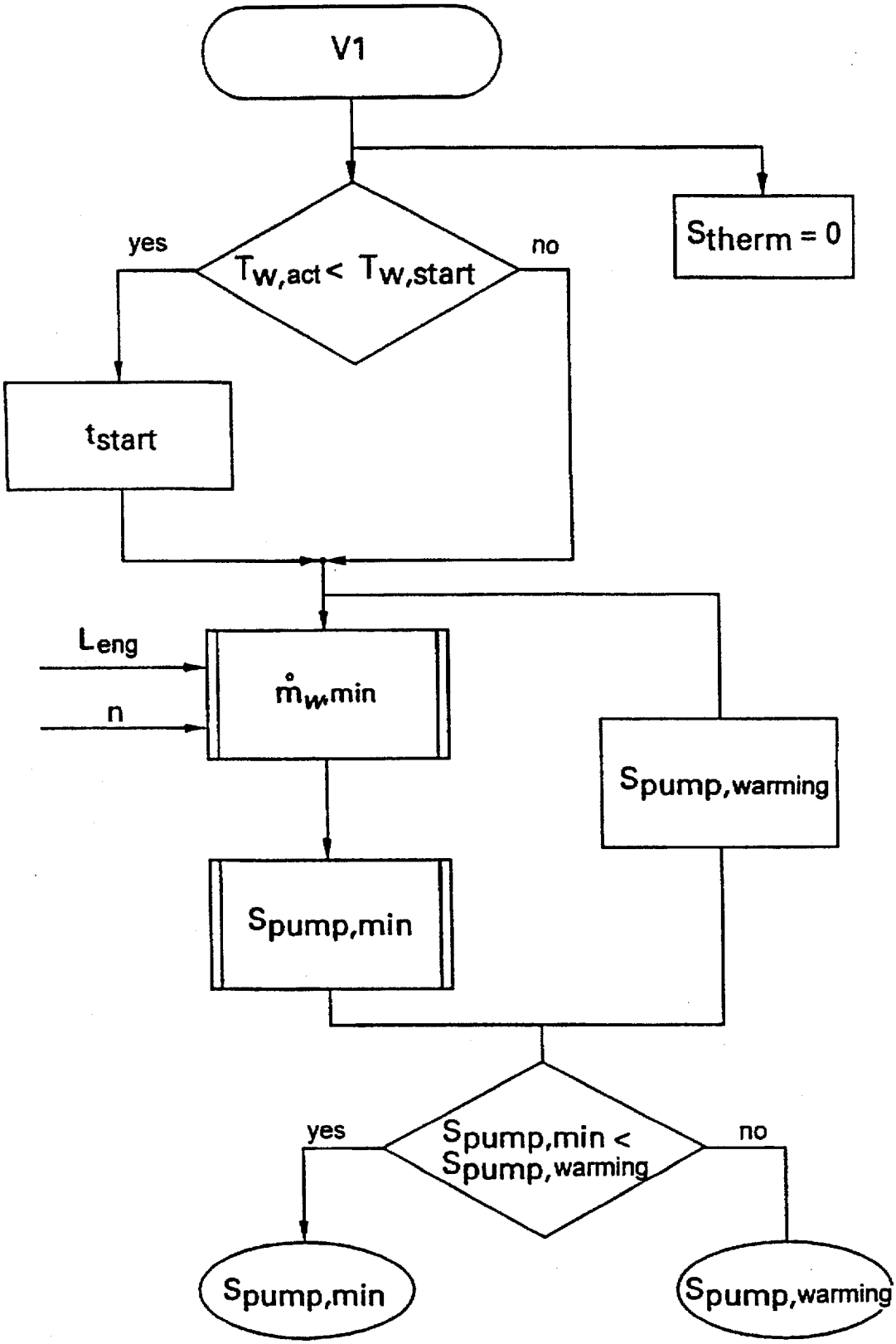
FIG. 3 is a flow chart illustrating a typical procedure for the control method during the warm-up phase of the internal combustion engine.
Figure 4:
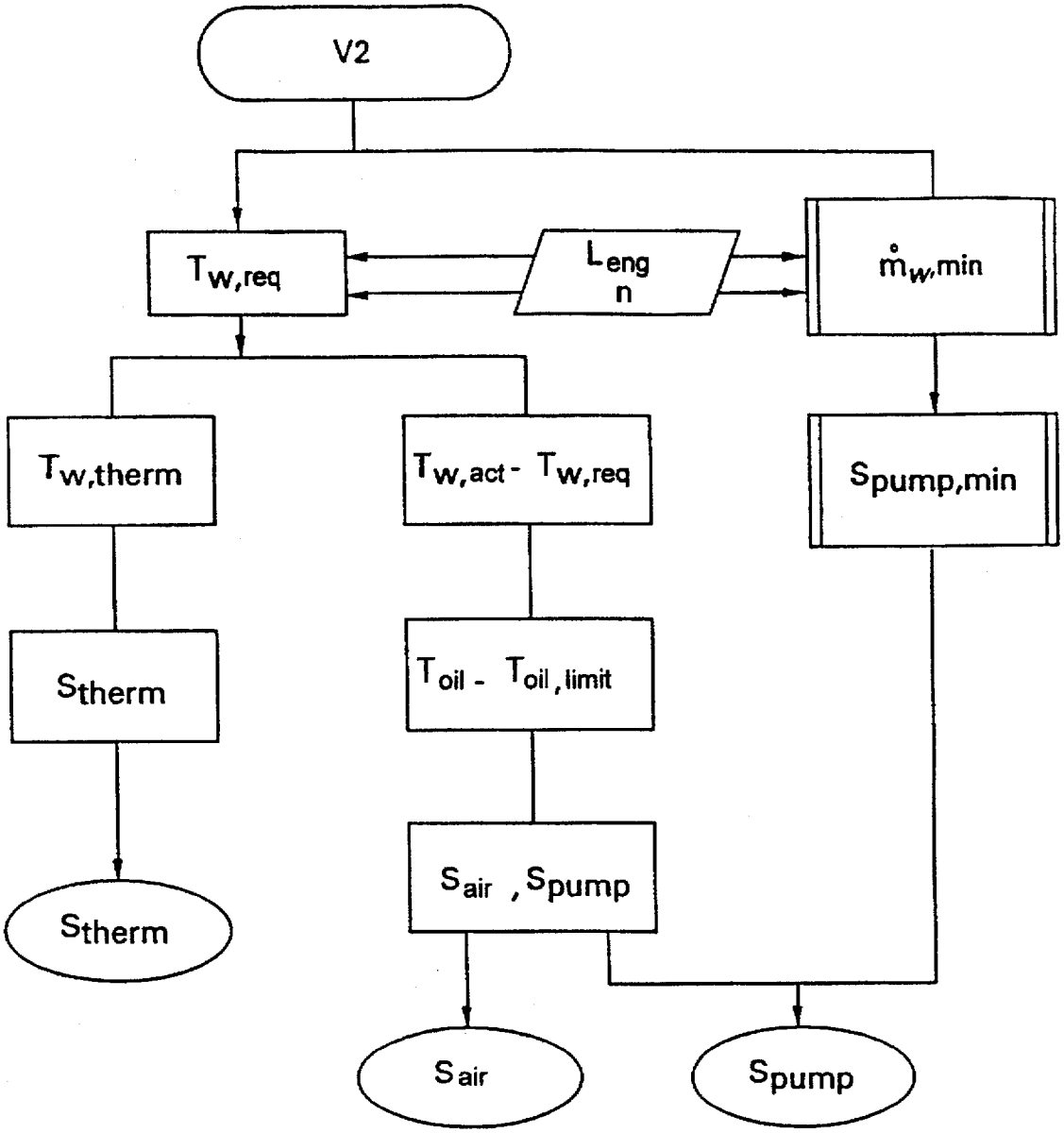
FIG. 4 is a flow chart illustrating a typical procedure for the control of the coolant temperature during normal engine operation.

The following is a description of the control method which is to be carried out by the control unit 5 for the coolant circuit. FIGS. 2–4 show flow charts for this control method by way of explanation. As shown in FIG. 2 three phases V1, V2 and V3, are distinguished in the method according to the invention: V1 is effective during the warming-up phase of the internal combustion engine; V2 is effective during driving with a normal operating temperature of the coolant; and V3 is effective during the cooling down phase. In the first method step A1, a check is carried out to determine whether the internal combustion engine 2 has been started. If this is the case, a comparison is made to determine whether the actual coolant temperature $T_{w,act}$ at the engine outlet, as indicated by the output signal $S_{sen}$ of the temperature sensor 11 is below a low temperature limit $T_{w,warming}$ which is selected to correspond to the end of the warm-up phase V1. If the coolant temperature $T_{w,act}$ has reached the temperature limit $T_{w,warming}$, the coolant circuit is controlled in accordance with the algorithm for phase V2 for driving at the normal coolant operating temperature.

If the internal combustion engine 2 has not been started, a check is carried out to determine whether the coolant temperature $T_{w,act}$ exceeds a high coolant temperature limit $T_{w,cooling}$, which indicates that the engine 2 must be cooled further. In this case, the coolant circuit is controlled using an algorithm for the cool-down phase V3. If the coolant temperature $T_{w,act}$ falls below the high temperature limit $T_{w,cooling}$, control of the cooling system stops until the internal combustion engine 2 is started again.

In the sequence of steps for the warming-up phase V1, which is illustrated in FIG. 3, a comparison of the coolant temperature $T_{w,act}$ at the engine outlet with a selected initial coolant temperature valve $T_{w,start}$ is carried out as the first step. If the coolant temperature is below the selected initial coolant value $T_{w,start}$, the coolant pump is started after a delay lasting for a time period $t_{start}$. This delay keeps the heat flow from components of the internal combustion engine 2 into the coolant as low as possible and thus achieves faster warming-up of the components. After that time period $t_{start}$ has elapsed, or the initial coolant temperature value $T_{w,start}$ has been reached, the coolant flow rate $\dot{m}_w$ produced by the coolant pump 3 is increased continuously, until the minimum coolant flow rate $\dot{m}_{w,win}$ for maintenance of the required temperature difference value $\Delta T_{w,eng,req}$ between the engine inlet and outlet is achieved for the first time. The drive signal $S_{pump,min}$ for the coolant pump 3 is calculated in the control unit 5 from the minimum coolant flow rate $\dot{m}_{w,win}$. Once the minimum coolant flow rate $\dot{m}_{w,win}$ has been reached for the first time, the operation of the coolant pump 3 is controlled by a drive signal $S_{pump,warming}$ in order to maintain the required temperature difference value $\Delta T_{w,eng,req}$ of the coolant at the intake and outlet of the engine. The actual temperature difference value $\Delta T_{w,eng,act}$ which is required for control results from the rate of heat flow $\dot{Q}_{eng}$ from the internal combustion engine into the coolant, which is in turn calculated from the instantaneous coolant flow rate $\dot{m}_w$, the instantaneous engine load $L_{eng}$ and the engine speed n. The calculated heat flow rate $\dot{Q}_{eng}$ is preferably stored in the control unit 5 as a performance graph for the specific internal combustion engine 2.

After the minimum coolant flow rate $\dot{m}_{w,win}$ has been reached, the coolant pump 3 should be prevented from reacting to brief engine load and speed changes. Since brief changes in the engine load $L_{eng}$ and the engine speed n are irrelevant for the heat flow rate $\dot{Q}_{eng}$ into the coolant because of the thermal inertia of the internal combustion engine 2, inclusion of the speed of the coolant pump 3 would result in unnecessary power consumption. The drive signal $S_{pump}$ for the coolant pump is thus given a dynamic transfer function whose time constants $T_{stg}$ are selected such that the time response of the coolant pump corresponds approximately to the response of the heat flow rate $\dot{Q}_{eng}$ from the internal combustion engine into the coolant. This causes the speed of the coolant pump to change in accordance with the change in the heat flow rate $\dot{Q}_{eng}$ into the coolant.

The fan is not driven during the warm-up phase V1. Consequently, except for any air flow produced by motion of the vehicle, no air flow rate $\dot{m}_1$, passes through the radiator 1. The warm-up phase V1 is complete when the instantaneous coolant temperature $T_{w,act}$ reaches the low temperature limit $T_{w,warming}$ for the first time.

As shown in FIG. 4, after the coolant temperature reaches the low temperature limit $T_{w,warming}$, the coolant temperature is also controlled as a function of a required coolant temperature value $T_{w,req}$ in accordance with the algorithm for driving at the operating temperature during the driving phase. The required temperature value $T_{w,req}$ is calculated first. For this purpose the control unit 5 has a stored performance graph in which the optimum required temperature value $T_{w,req}$ for the predetermined engine temperature is stored for a variable engine load $L_{eng}$, engine speed n and coolant flow rate $\dot{m}_w$. The control temperature $T_{w,therm}$ for the temperature-dependent valve 6, from which temperature the drive signal $S_{therm}$ for the temperature-dependent valve 6 is determined, results from this variable required temperature value $T_{w,req}$ at the engine outlet, the coolant flow rate $\dot{m}_w$ and the heat flow rate $\dot{Q}_{eng}$ from the internal combustion engine 2 into the coolant. In the same way as in a conventional cooling circuit, the valve 6 controls the coolant temperature $T_{w,act}$ by controlling the coolant flow relationships between the pipe a, which leads to the radiator 1 and the radiator bypass pipe b.

The calculation of the minimum coolant flow rate $\dot{m}_{w,win}$ produces the required minimum speed for the coolant pump 3 and thus the optimum drive signal $S_{pump,min}$. If the instantaneous coolant temperature $T_{w,act}$ exceeds the required temperature value $T_{w,req}$ at the engine outlet by a difference value $\Delta T_{w,hot}$, then either the speed of the coolant pump 3, and thus the coolant flow rate $\dot{m}_w$, or the speed of the fan 4, and thus the air flow rate $\dot{m}_1$, is increased. A time comparison of the efficiencies of the coolant pump 3 and of the fan 4 for heat dissipation at the radiator 1 is carried out in order to determine whether it makes more sense in terms of power to change the speed of the coolant pump 3 or of the fan 4. The heat dissipation of the heat flow $\dot{Q}_{w,k}$ at the radiator 1 depends on the coefficient of heat transmission k, which is obtained from the coolant/radiator and radiator/air coefficients of heat transfer, and is calculated in accordance with the formula:

$$k=\frac{1}{A_k}\cdot\frac{(\dot{m}_l\cdot\dot{m}_w)^{0.8}}{a_k\cdot\dot{m}_w^{0.8}+b_k\cdot\dot{m}_l^{0.8}+c_k(\dot{m}_l\cdot\dot{m}_w)^{0.8}}$$

in which $A_k$ is the area of the radiator 1 and $a_k$, $b_k$ and $c_k$ are constants for the calculation of the coefficient of heat transmission.

In order to assess the effectiveness of changing the air flow rate $\dot{m}_1$ and the coolant flow rate $\dot{m}_w$, the partial derivatives are formed:

$$\frac{\partial k\cdot A_k}{\partial \dot{m}_l}=\frac{0.8\cdot\dot{m}_l^{-0.2}}{\left(a_k+\left(\frac{b_k}{\dot{m}_w^{0.8}}+c_k\right)\cdot\dot{m}_l^{0.8}\right)^2}=\eta_{k,l}$$

and $$\frac{\partial k\cdot A_k}{\partial \dot{m}_w}=\frac{0.8\cdot\dot{m}_w^{-0.2}}{\left(b_k+\left(\frac{a_k}{\dot{m}_l^{0.8}}+c_k\right)\cdot\dot{m}_w^{0.8}\right)^2}=\eta_{wapu}$$

The magnitude of the increase in heat dissipation per unit mass of the materials involved is thus obtained for each operating point of the radiator. If these values are now compared with the power inputs $P_L$ and $P_{wapu}$ which are required to provide the necessary coolant flow rate and air flow rate, respectively, a comparison value $K_\eta$ is obtained for assessment of the most favorable operating point change.

$$K_\eta=\frac{\eta_{k,l}\cdot\frac{1}{P_L}}{\eta_{k,wapu}\cdot\frac{1}{P_{wapu}}}$$

If the comparison value $K_{72}\geqq 1$, then in terms of efficiency it is more favorable to increase the air flow rate $\dot{m}_1$. If $K_{72}\leqq 1$, the coolant flow rate $\dot{m}_w$ should be increased. If the coolant circuit through a cooler 9 is used in order to cool the engine oil as illustrated in FIG. 1, the instantaneous oil temperature $T_{oil}$ can be monitored using a sensor which is not illustrated. If the instantaneous oil temperature $T_{oil}$ exceeds a high temperature limit $T_{oil,limit}$, then the coolant temperature $T_{w,act}$ is reduced step by step until the oil temperature $T_{oil}$ falls below this high temperature limit. The required coolant temperature is then set to provide the selected engine temperature.

The dynamic control response to brief changes in the engine load $L_{eng}$ in the engine speed n for the maintenance of the required temperature difference value $\Delta T_{w,eng,req}$ differs from the response for the maintenance of the required temperature value $T_{w,req}$. The dynamic of control in accordance with the required temperature difference value $\Delta T_{w,eng,req}$ corresponds to that for the warm up phase V1. The dynamic control in accordance with the required temperature value $T_{w,req}$ by variation of the valve flow $S_{therm}$ and of the speeds of the coolant pump 3 and fan 4 must take place more rapidly. A design compromise must be found between the optimum in terms of power and the desired temperature constancy of the components of the internal combustion engine 2. For the power analysis, it makes sense to ignore brief temperature changes of the components as occur, for example, during overtaking. If the optimization is made in the direction of temperature constancy of the components of the internal combustion engine, then the reaction to changes in the engine load can be used to carry out initial control with respect to changing the coolant temperature $T_{w,act}$ or the heat flow rate $\dot{Q}_{eng}$ into the coolant. If an engine operating point is set which would result in an increased heat flow rate $\dot{Q}_{eng}$ into the coolant, then colder coolant can be pumped into the internal combustion engine by controlling the temperature-dependent valve 6, which results in an increased heat flow rate $\dot{Q}_{eng}$ into the coolant and thus smaller component temperature fluctuations. Furthermore, the coolant flow rate $\dot{m}_w$ or the air flow rate $\dot{m}_1$ can be increased in anticipation of such requirement. This is recommended in particular if the valve 6 is not able to follow fast changes.

Although the invention has been described herein with reference to specific embodiments, many modifications and variations therein will readily occur to those skilled in the art. Accordingly, all such variations and modifications are included within the intended scope of the invention.

I claim:

1. A method for controlling a cooling circuit of an internal combustion engine having at least one coolant pump for controlling the rate of flow of coolant in the coolant circuit, a radiator in which heat is exchanged between air passing through the radiator and coolant in the radiator, a fan for controlling the flow of air through the radiator, and a control unit for controlling the speed of the coolant pump comprising the steps of controlling the speed of the coolant pump and the fan when the coolant temperature is below a predetermined low limit temperature value as a function of a required temperature difference between the coolant temperatures at a coolant inlet to the engine and at a coolant outlet from the engine, which is determined using at least two engine operating parameters which affect engine temperature, one of the inlet and outlet temperatures being sensed and the other being determined according to the at least two engine operating parameters, and controlling the speed of the coolant pump and the speed of the fan when the coolant temperature is above the predetermined selected low limit temperature value as a function of both the required temperature difference and a required coolant operating temperature.

2. A method according to claim 1 wherein at least one of the required temperature difference and the required coolant operating temperature is dependent upon an operating parameter of the internal combustion engine.

3. A method according to claim 1 including the step of delaying operation of the coolant pump and of the fan for a predetermined time period after engine start-up when the coolant temperature is below an initial temperature level which is below the predetermined low limit temperature value.

4. A method according to claim 3 wherein the length of the predetermined time period is selected so that no hot spots can occur in the engine and is dependent upon said at least two operating parameters.

5. A method according to claim 1 wherein the control unit controls the operation of the coolant pump and the fan with a time an empirically determined stored constant after a change in an engine operating parameter which depends on the rate of heat transfer from the engine to the coolant so as to prevent the cooling system from reacting quickly to brief changes in engine operating parameters.

6. A method according to claim 1 including the step of controlling the coolant pump and the fan when the coolant temperature is above the predetermined low limit temperature value as a function of the relation between the heat transfer efficiencies of the coolant flow produced by the coolant pump and the air flow produced by the fan for heat dissipation at the radiator.

7. A method according to claim 1 wherein the required coolant operating temperature is a function of the at least two engine operating parameters.

8. A method according to claim 1 wherein an actual temperature difference value between the temperature of the coolant at an engine inlet and at an engine outlet which is required for control of the coolant temperature is determined from the rate of heat flow from the engine into the coolant determined from said at least two parameters and from the flow rate of coolant flow through the engine based on a pump control signal.

9. A method according to claim 8 wherein the rate of heat flow from the engine into the coolant and the coolant flow rate are obtained from information stored in the control unit.

* * * * *

UNITED STATES PATENT AND TRADEMARK OFFICE
CERTIFICATE OF CORRECTION

PATENT NO. : 5,724,924

DATED : March 10, 1998

INVENTOR(S) : Karsten Michels

It is certified that error appears in the above-identified patent and that said Letters Patent is hereby corrected as shown below:

First page, Item 22, "Feb. 6" should read --Mar. 6--;

Column 1, line 15, "pulp" should read --pump--;

Column 1, line 16, "45 476 A" should read --54 476 A--;

Column 6, line 10, "$\eta_{wapu}$" should read --$^{\eta}$wapu--;

Column 6, line 26, "$^{K}72$" should read --$^{K}\eta$--;

Column 6, line 28, "$^{K}72$" should read --$^{K}\eta$--.

Signed and Sealed this

Sixth Day of April, 1999

Q. Todd Dickinson

Attest:

Q. TODD DICKINSON

Attesting Officer

Acting Commissioner of Patents and Trademarks